US009650175B2

(12) United States Patent
Wu

(10) Patent No.: US 9,650,175 B2
(45) Date of Patent: May 16, 2017

(54) CONTAINER

(76) Inventor: Kuo-Cheng Wu, Kaohsiung (TW)

( * ) Notice: Subject to any disclaimer, the term of this patent is extended or adjusted under 35 U.S.C. 154(b) by 0 days.

(21) Appl. No.: 13/208,446

(22) Filed: Aug. 12, 2011

(65) Prior Publication Data

US 2013/0037427 A1 Feb. 14, 2013

(51) Int. Cl.

| | |
|---|---|
| ***B65D 25/08*** | (2006.01) |
| ***B65D 51/00*** | (2006.01) |
| ***A61J 1/20*** | (2006.01) |

(52) U.S. Cl.

CPC ..... *B65D 25/085* (2013.01); *A61J 1/2093* (2013.01); *B65D 51/002* (2013.01); *A61J 1/2037* (2015.05)

(58) Field of Classification Search

CPC .... A61J 1/2093; B65D 25/085; B65D 51/002
USPC ..... 206/219, 220, 221; 215/DIG. 8
See application file for complete search history.

(56) References Cited

U.S. PATENT DOCUMENTS

| | | | | |
|---|---|---|---|---|
| 1,275,315 | A * | 8/1918 | Smith | 206/221 |
| 1,343,085 | A * | 6/1920 | Lerch | 604/311 |
| 2,275,567 | A * | 3/1942 | Smith | 604/416 |
| 2,689,566 | A * | 9/1954 | Lockhart | 604/295 |
| 2,764,156 | A * | 9/1956 | Fernandez et al. | 206/221 |
| 2,764,157 | A * | 9/1956 | Fernandez et al. | 206/221 |
| 2,787,268 | A * | 4/1957 | Greenspan | 206/221 |
| 3,321,097 | A * | 5/1967 | Solowey | 206/221 |
| 4,453,636 | A * | 6/1984 | Meadows et al. | 206/534 |
| 5,143,211 | A * | 9/1992 | Miczka et al. | 206/221 |
| 5,593,028 | A * | 1/1997 | Haber et al. | 206/221 |
| 6,021,892 | A | 2/2000 | Baudin | |
| 6,644,471 | B1 * | 11/2003 | Anderson | 206/222 |

FOREIGN PATENT DOCUMENTS

| | | |
|---|---|---|
| TW | 200722072 | 6/2007 |
| TW | 200730166 | 8/2007 |

* cited by examiner

*Primary Examiner* — J. Gregory Pickett
*Assistant Examiner* — Jenine Pagan
(74) *Attorney, Agent, or Firm* — Alan D. Kamrath; Kamrath IP Lawfirm, P.A.

(57) ABSTRACT

A container includes a body, at least one partitioning plug, a stopper and a driving rod. The body has an opening on one end thereof, as well as a closed end on an other end thereof. The at least one partitioning plug is disposed in the body to divide the body into at least two chambers, wherein each of the at least one partitioning plug has a through-hole. The stopper is disposed at the opening of the body and has a through-hole. The driving rod is equipped with at least one blocking portion movably engaged in the through-hole or through-holes of the at least one partitioning plug, wherein one end of the driving rod protrudes from the opening of the body.

9 Claims, 9 Drawing Sheets

CONTAINER

BACKGROUND OF THE INVENTION

1. Field of the Invention

The present invention generally relates to a medicament container and, more particularly, to a medicament container that can accommodate multiple medicaments and can mix the medicaments before use of the medicaments.

2. Description of the Related Art

Referring to FIG. 1, a conventional medicament container 9 is disclosed by Taiwanese Publication No. 200730166 entitled "dual-chamber container without bypass". The medicament container 9 includes a tube 91, an upper plug 92, a lower plug 93, a portioning plug 94, an upper chamber 95, a lower chamber 96 and a hollow needle 97. The upper plug 92 and the lower plug 93 are arranged on two ends of the tube 91. The portioning plug 94 has a height H and is disposed in the tube 91. The upper chamber 95 is formed between the portioning plug 94 and the upper plug 92, and the lower chamber 96 is formed between the portioning plug 94 and the lower plug 93. The upper chamber 95 and the lower chamber 96 may receive different medicaments. The hollow needle 97 has a length L and may be assembled to a bottom of the upper plug 92. The hollow needle 97 has a pointed end at one end thereof, as well as at least one opening 971 at the other end thereof. The length L is larger than the height H.

When in use, a user can push the upper plug 92 down the tube 91 to cause movement of the hollow needle 97. The moving needle 97 will penetrate the portioning plug 94 and cause the medicament received in the upper chamber 95 to enter the lower chamber 96 via the opening 971 of the hollow needle 97. Therefore, mixture of the medicaments will take place in the lower chamber 96.

When the hollow needle 97 penetrates the portioning plug 94, however, a small particle or portion of the portioning plug 94 will be broken off by the hollow needle 97. The crumb of the portioning plug 94 will get stuck in the hollow needle 97 and hinder the medicament in the upper chamber 95 from entering the lower chamber 96. This results in a poor and slow mixture of the medicaments. Furthermore, since the upper plug 92, the lower plug 93 and the portioning plug 94 tightly abut against an inner circumferential face of the tube 91, an air pressure exists in both the upper chamber 95 and the lower chamber 96. As a result, it will take more strength to drive the upper plug 92 into the tube 91, making it more difficult for the hollow needle 97 to penetrate the portioning plug 94 and causing an inconvenient use of the medicament container 9.

Referring to FIG. 2, another conventional medicament container 8 is disclosed by Taiwanese Publication No. 200730166 entitled "dual-chamber container without bypass in the cylindrical body". The medicament container 8 includes a tube 81, an upper plug 82, a lower plug 83, a portioning plug 84, an upper chamber 85, a lower chamber 86 and a shaping member 87. The upper plug 82 and the lower plug 83 are arranged on two ends of the tube 81. The portioning plug 84 is disposed in the tube 81. The upper chamber 85 is formed between the portioning plug 84 and the upper plug 82, and the lower chamber 86 is formed between the portioning plug 84 and the lower plug 83. The portioning plug 84 has an opening 841 extending therethrough axially, and the opening 841 has an upper portion 841*a* and a lower portion 841*b*. The upper portion 841*a* has a smaller radial cross section than the lower portion 841*b*. The shaping member 87 is received in the upper portion 841*a*.

The medicament container 8 is designed in a way that allows the shaping member 87 to be popped out of the upper portion 841*a* of the opening 841 when the air in the upper chamber 85 is compressed by a use pushing the upper plug 82. Once the shaping member 87 disengages from the upper portion 841*a* of the opening 841 and falls into the lower portion 841*b*, the upper chamber 85 will be able to communicate with the lower chamber 86, thereby providing mixture of the medicaments.

Similar to the medicament container 9 stated in FIG. 1, however, an air pressure also exists in the upper chamber 85 and the lower chamber 86. This makes it more difficult to drive the upper plug 82 down the tube 81. Furthermore, when the upper plug 82 is driven, not only the shaping member 87 but also the portioning plug 84 will be forced down under the air pressure caused by a user driving the upper plug 82. As a result, it will be more difficult to force the shaping member 87 out of the portioning plug 84 since there is no device provided in the tube 81 that can stop the portioning plug 84 from moving when subjected to an air pressure. Thus, the medicament container 9 also has a poor mixture of medicaments.

Besides, the medicament containers 8 and 9 also require a long and narrow tool for driving the upper plugs 82 and 92, leading to an even poorer operability of the medicament containers 8 and 9.

Referring to FIGS. 3*a* and 3*b*, another conventional container 7 is disclosed by U.S. Pat. No. 6,021,892 entitled "Device for packaging a product comprising constituents which must be stored separately and mixed just before use of the product". The container 7 has an upper chamber 71*a* and a lower chamber 71*b*. An opening 72 is formed between the chambers 71*a* and 71*b*. A partitioning plate 73 is provided to cover the opening 72. A driving rod 74 extends upwards from the partitioning plate 73 and has a top end that can be connected to a deformable area 75 protruding from a ceiling of the upper chamber 71*a*.

Based on the structure, one can cause the driving rod 74 and the partitioning plate 73 to disengage from the opening 72 by pressing the deformable area 75 of the container 7. Thus, communication between the chambers 71*a* and 71*b* is provided and mixture of the materials stored in the chambers 71*a* and 71*b* is attained.

However, the container 7 has a complex interior structure and the manufacturing costs thereof are therefore higher. In a case where the container 7 has three chambers (or more chambers), the driving rod 74 and the partition plate 73 falling from the opening 72 between the upper two chambers may accidentally cover the opening 72 between the lower two chambers. As a result, the three chambers will not have a desired communication. Thus, it will require the user to shake the container 7 to better mix the materials stored in the three chambers, resulting in an inconvenient use.

SUMMARY OF THE INVENTION

It is therefore the primary objective of this invention to provide a medicament container with simple structure that allows chambers thereof to communicate with each other by simply driving a driving rod to disengage a blocking portion of the driving rod from a partitioning plug.

It is another objective of this invention to provide a medicament container that can provide a desired communication for chambers thereof during use.

The invention discloses a container comprising a body, at least one partitioning plug, a stopper and a driving rod. The body has an opening on one end thereof, as well as a closed end on other end thereof. The at least one partitioning plug is disposed in the body to divide the body into at least two chambers, wherein each of the at least one partitioning plug has a through-hole. The stopper is disposed at the opening of the body and has a through-hole. The driving rod is equipped with at least one blocking portion movably engaged in the through-hole or through-holes of the at least one partitioning plug, wherein one end of the driving rod protrudes from the opening of the body.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
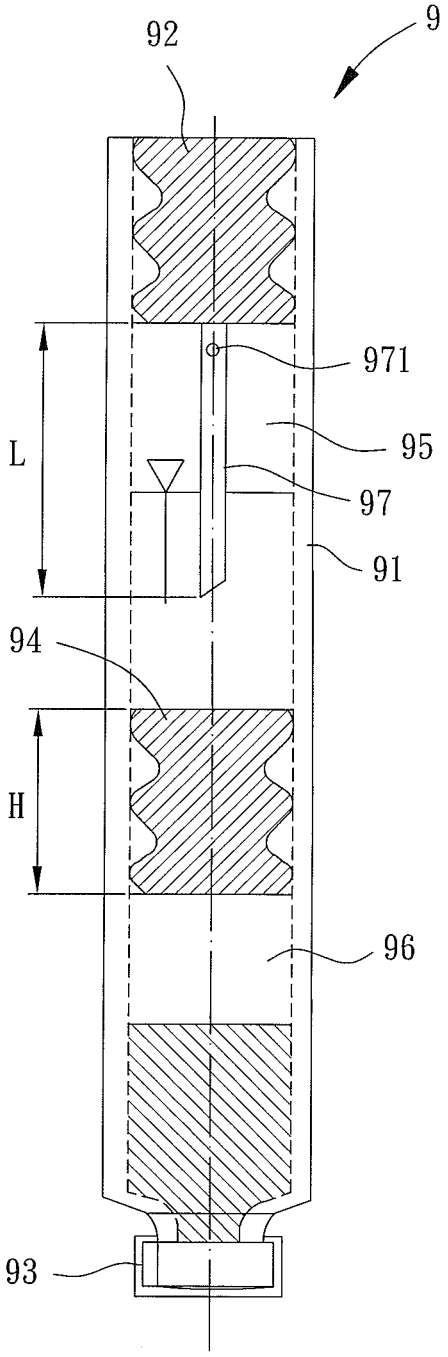
FIG. 1 PRIOR ART
FIG. 1 is a cross-sectional view of a conventional medicament container.
Figure 2:
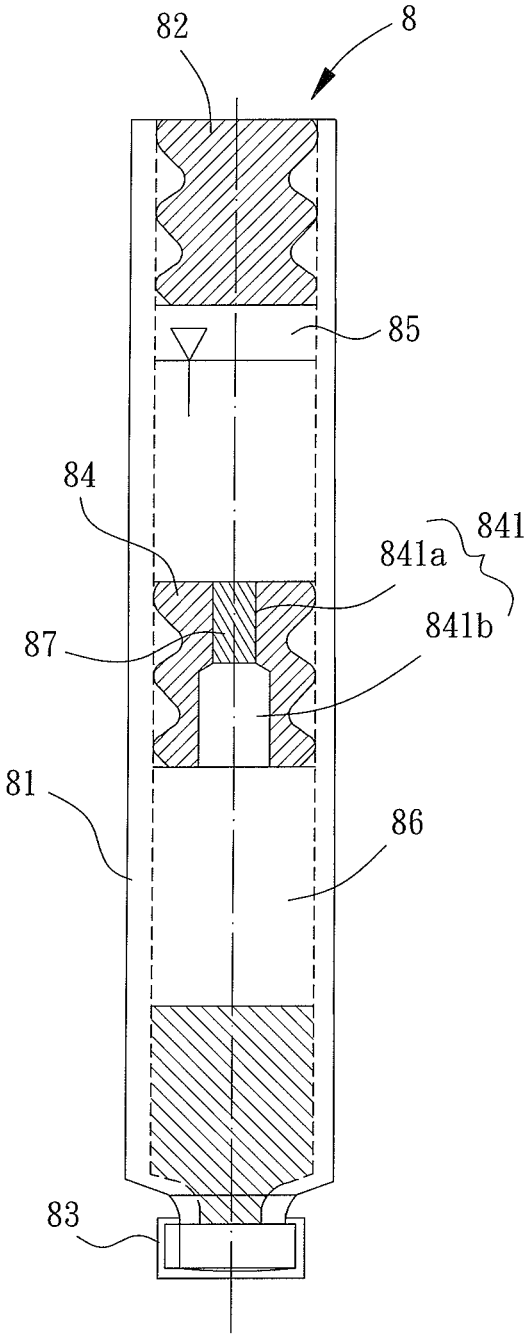
FIG. 2 PRIOR ART
FIG. 2 is a cross-sectional view of another conventional medicament container.
Figure 3B:
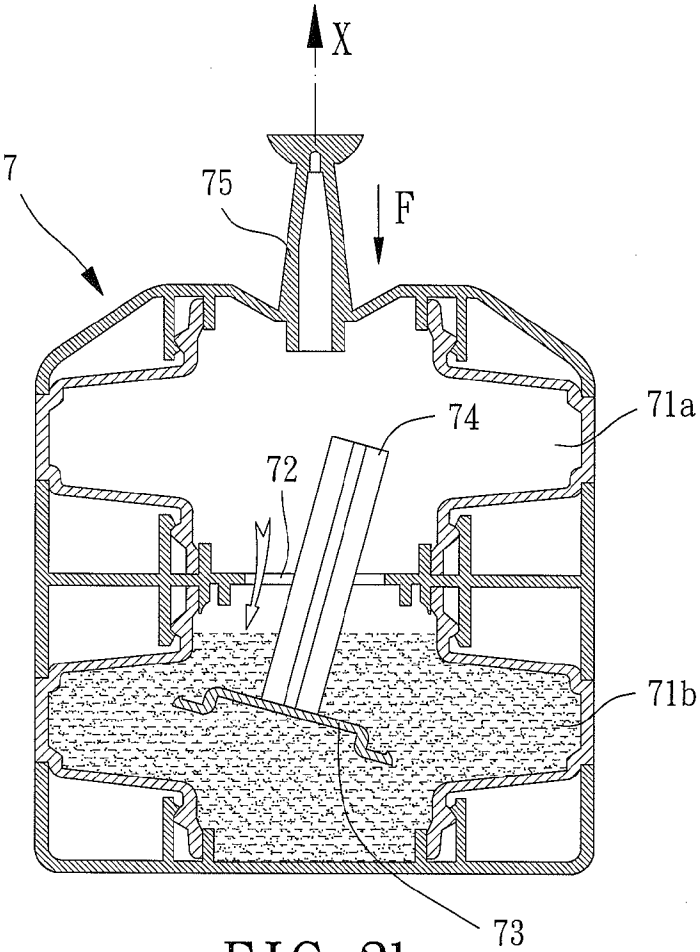
FIG. 3b PRIOR ART
FIG. 3*b* shows use of the conventional medicament container of FIG. 3*a*.
Figure 3A:
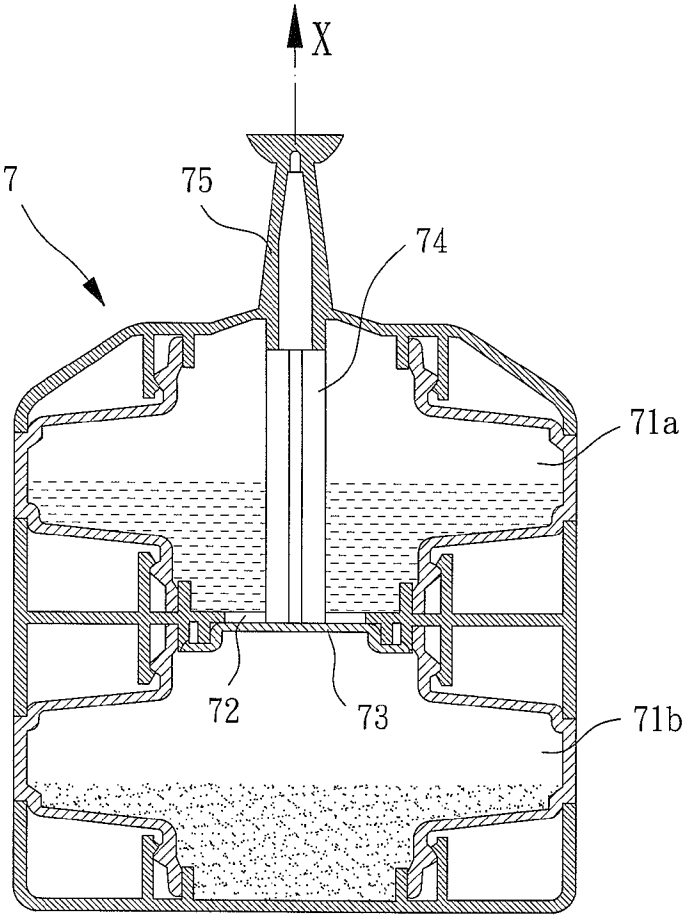
FIG. 3a PRIOR ART
FIG. 3*a* is a cross-sectional view of yet another conventional medicament container.

In the various figures of the drawings, the same numerals designate the same or similar parts. Furthermore, when the term "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 4:
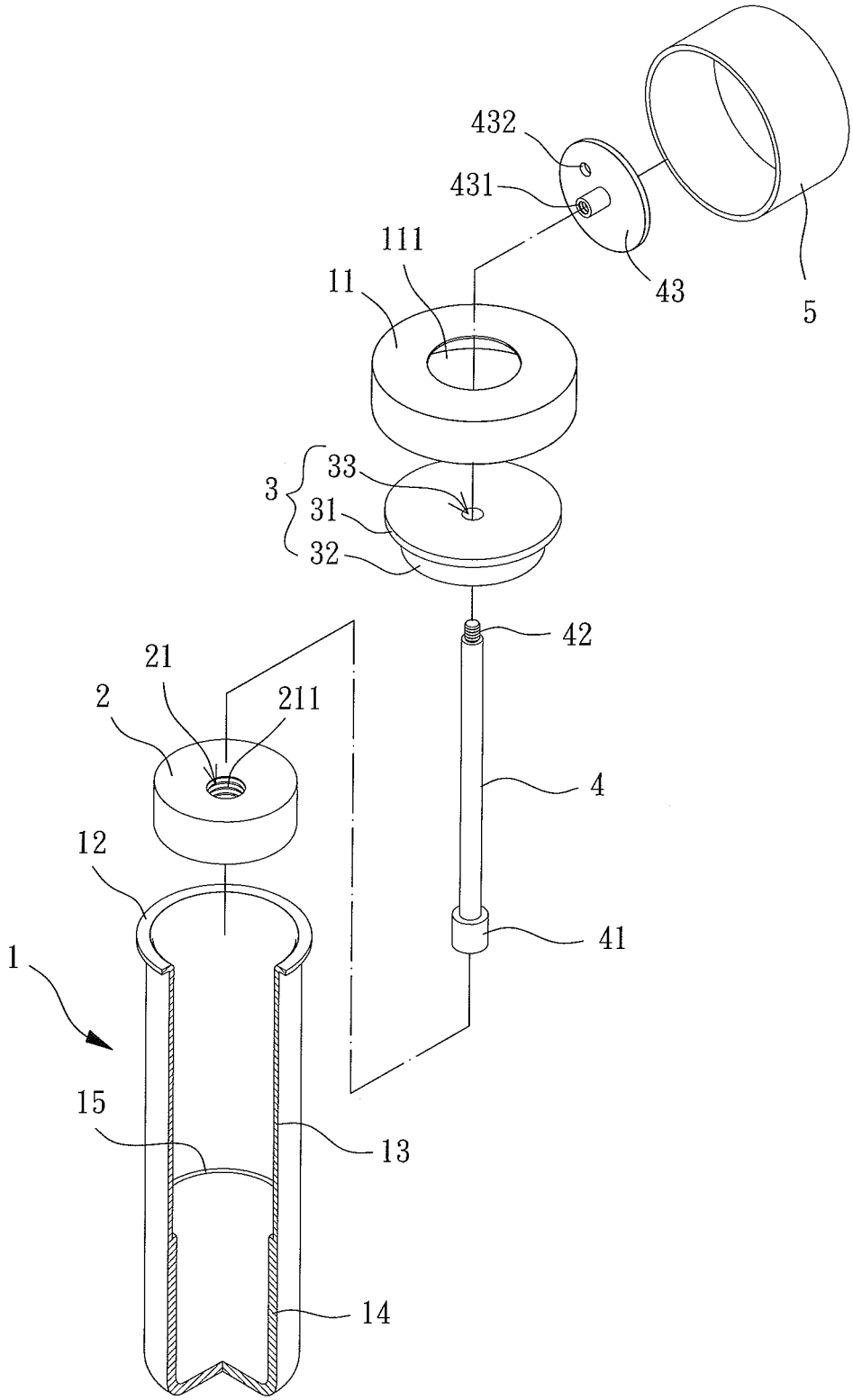
FIG. 4 is an exploded view of a medicament container according to a first embodiment of the invention.

Referring to FIG. 4, an exploded view of a medicament container is shown according to a first embodiment of the invention. The medicament container includes a body 1, at least one partitioning plug 2, a stopper 3 and a driving rod 4. The at least one partitioning plug 2 is disposed in the body 1 to divide the interior area of the body 1 into at least two chambers. The stopper 3 is provided to cover an opening of the body 1. The driving rod 4 can control communication of the at least two chambers.

The body 1 has the opening on one end thereof, as well as a closed end on the other end thereof. The opening of the body 1 may couple with a cover 11 having a through-hole 111. The through-hole 111 may be arranged at a center of the cover 11. In this embodiment, the cover 11 may be implemented as an aluminum cover that is commonly used to cover an opening of a bottle. The body 1 can further form a flange 12 on the opening thereof in order for the cover 11 to couple with the body 1 in a stable manner. In this case, a machine may be used to securely fix the cover 11 to the opening of the body 1 by folding the cover 11 inwards after the flange 12 is covered with the cover 11, as shown in FIG. 5.

The body 1 has a plurality of sections with different inner diameters to define a plurality of chambers with different sizes. In light of this, the body 1 has a gradually-reduced inner diameter from the opening to the closed end thereof. In other words, the inner diameter of the body 1 will reduce by a scale after each partitioning plug 2. In this embodiment, the body 1 can be divided into an upper section 13 and a lower section 14. The upper section 13 is adjacent to the opening of the body 1 and the lower section 14 is adjacent to the closed end of the body 1. The upper section 13 has an even diameter and the lower section 14 has a smaller diameter than the upper section 13. As such, a blocking face 15 is formed where the upper section 13 connects with the lower section 14.

Figure 5:
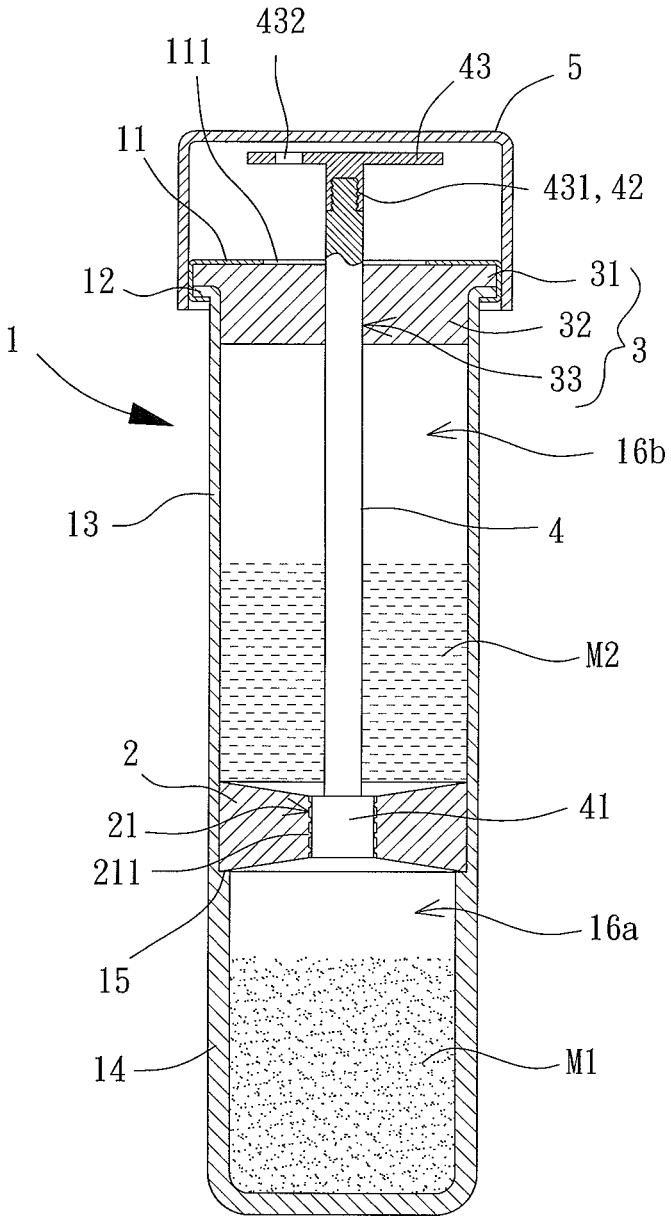
FIG. 5 is a cross-sectional view of the medicament container of the first embodiment of the invention.

Referring to FIGS. 4 and 5, the at least one partitioning plug 2 may include a single partitioning plug 2 whose outer diameter is equal to the inner diameter of the upper section 13 but larger than the inner diameter of the lower section 14. Thus, the partitioning plug 2 can be tightly disposed in the upper section 13 of the body 1 while resting on the blocking face 15 between the upper section 13 and the lower section 14. A first chamber 16*a* is formed between the partitioning plug 2 and the closed end of the body 1, and a second chamber 16*b* is formed between the partitioning plug 2 and the opening of the body 1. The partitioning plug 2 has a through-hole 21. A plurality of protruding rings 211 is preferably formed on a circumferential wall of the through-hole 21. The partitioning plug 2 has a gradually-reduced thickness from an outer periphery to the through-hole 21. As such, top and bottom faces of the partitioning plug 2 are of an inclined form. Based on the inclined top and bottom faces, the powdered or liquid medicament can smoothly flow from one chamber 16*a* or 16*b* to the other chamber 16*a* or 16*b* via the through-hole 21, thereby providing a smooth movement for medicaments received therein.

The stopper 3 may be disposed at the opening of the body 1 to seal the second chamber 16*b*. In this embodiment, the stopper 3 includes a shoulder portion 31 and a plug portion 32. The shoulder portion 31 has a diameter equal to an outer diameter of the flange 12 (the outer diameter of the flange 12 is determined from a center to an outer periphery thereof). The plug portion 32 has a diameter smaller than that of the shoulder portion 31 but equal to the inner diameter of the body 1. In this arrangement, when the stopper 3 is coupled with the opening of the body 1, the plug portion 32 of the stopper 3 is stuffed into the body 1 until a bottom face of the shoulder portion 31 abuts against a top face of the flange 12. This avoids the stopper 3 from moving when the stopper 3 is subjected to a force that pushes the stopper 3 further into the body 1. The cover 11 may press a top face of the stopper 3 to prevent disengagement of the stopper 3. The stopper 3 has a through-hole 33 coaxial with the through-holes 111 and 21 of the cover 11 and the partitioning plug 2.

The driving rod 4 has a diameter substantially equal to that of the through-hole 33. The driving rod 4 further includes at least one blocking portion 41 that can be integrally formed on or assembled to the driving rod 4. The quantity of the at least one blocking portion 41 may be the same as that of the at least one partitioning plug 2. In this embodiment, only one blocking portion 41 is provided in correspondence to the single partitioning plug 2. The blocking portion 41 may be arranged on one end of the driving rod 4, and has a diameter larger than that of the driving rod 4 but equal to that of the through-hole 21 of the partitioning plug 2. In addition, the shape of the blocking portion 41 corresponds to that of the through-hole 21 of the partitioning plug 2. The blocking portion 41 can be tightly received in the through-hole 21 via the protruding rings 211 to improve the coupling between the blocking portion 41 and the through-hole 21. Thus, undesired communication between the first chamber 16*a* and the second chamber 16*b* is prevented.

The driving rod 4 can extend through the through-hole 33 of the stopper 3 in a tight-fitting manner. One end of the driving rod 4 can extend through the through-hole 111 of the cover 11 and protrude from the opening of the body 1. In this arrangement, a user can cause the blocking portion 41 to move by pressing the driving rod 4, forcing the blocking portion 41 to disengage from the through-hole 21 of the partitioning plug 2. Thus, communication between the first chamber 16*a* and the second chamber 16*b* will become possible.

The driving rod 4 may further include an engaging portion 42 on the other end thereof, as well as a holding disc 43 that can be held by a user pressing the driving rod 4. Arrangement of the holding disc 43 allows the user to drive the driving rod 4 in an easier way. The holding disc 43 has an engaging portion 431 that can be coupled with the engaging portion 42 of the driving rod 4 by ways of screwing or fastening as is well known in the art. In a case where screwing is adapted, threads can be arranged on an outer circumferential wall of the engaging portion 42 of the driving rod 4 and on a circumferential wall of the engaging portion 431 if the engaging portion 431 is implemented as an engaging hole having the circumferential wall. Alternatively, if the engaging portion 42 of the driving rod 4 other than the engaging portion 431 is implemented as an engaging hole having a circumferential wall, threads can be arranged on the circumferential wall of the engaging portion 42 and on an outer circumferential wall of the engaging portion 431.

The holding disc 43 has a needle hole 432 overlapped with the through-hole 111 of the cover 11 in an axial direction when assembly of the medicament container is completed. In such an arrangement, a needle 61 of a syringe 6 (referring to FIG. 7) may pierce the stopper 3 via the needle hole 432 and the through-hole 111 to draw the mixed medicament from the second chamber 16*b*. The body 1 may further include an outer cover 5 that completely covers the holding disc 43 and the driving rod 4. The outer cover 5 can prevent undesired communication between the first chamber 16*a* and the second chamber 16*b* caused by a user accidentally pressing the driving rod 4, while providing a dustproof function for the medicament container at the same time.

Referring to FIG. 5, when in assembly, a predetermined amount of a first medicament M1 is filled into the body 1. Then, the partitioning plug 2 is stuffed and driven down the body 1 until the partitioning plug 2 rests on the blocking face 15 where the upper section 13 connects with the lower section 14. Finally, the blocking portion 41 of the driving rod 4 is engaged in the through-hole 21 of the partitioning plug 2 to seal the first chamber 16*a*. Alternatively, the driving rod 4 can couple with the partitioning plug 2 in advance before the partitioning plug 2 is stuffed into the body 1.

Next, a predetermined amount of a second medicament M2 is filled into the body 1. Then, the stopper 3 is coupled with the opening of the body 1 after being fitted around the driving rod 4. The driving rod 4 extends through the through-hole 33 of the stopper 3 in a tight-fitting manner to seal the second chamber 16*b*. In this embodiment, one or both of the first medicament M1 and the second medicament M2 are liquid.

Next, the cover 11 is fitted around the driving rod 4 via the through-hole 111 and caused to couple with the flange 12 of the body 1. The holding disc 43 is then coupled with the driving rod 4, and the top of the body 1 is finally covered with the outer cover 5 to complete assembly of the medicament container of the invention.

Figure 6:
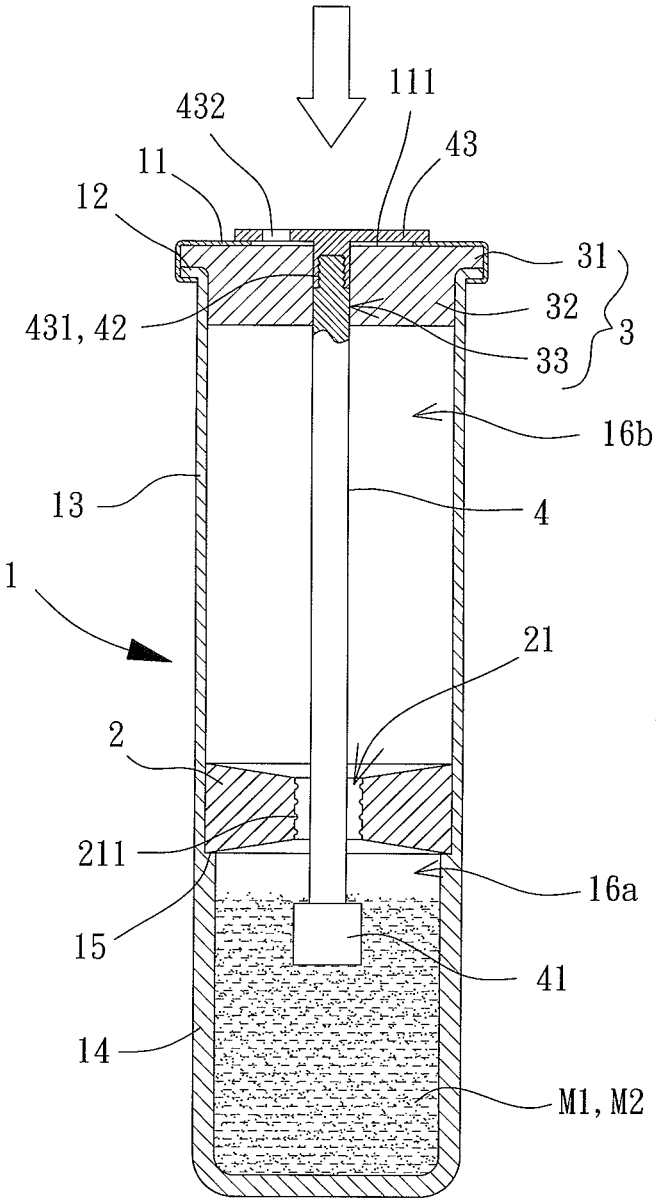
FIG. 6 is an operation view of the medicament container of the first embodiment of the invention.

Referring to FIG. 6, when in use, the outer cover 5 can be removed from the body 1. Then, the holding disc 43 is pressed to drive the driving rod 4 down the body 1 so as to disengage the blocking portion 41 of the driving rod 4 from the through-hole 21 of the partitioning plug 2. This allows the first chamber 16*a* to communicate with the second chamber 16*b*. At this point, based on the material form of the first medicament M1 and the second medicament M2, a user can hold the medicament container in the same way as indicated in FIG. 5 where the opening of the body 1 faces upwards, or turn the medicament container upside-down to have the opening of the body 1 faces downwards (as opposed to what is shown in FIG. 5). In this embodiment, since the first medicament M1 is in a solid form (powder form) and the second medicament M2 is in a liquid form, the medicament container can be held in the same manner as indicated in FIG. 5 (where the opening of the body 1 faces upwards), so that the liquid second medicament M2 in the second chamber 16*b* can be poured into the first chamber 16*a* to mix with the first medicament M1.

Figure 7:
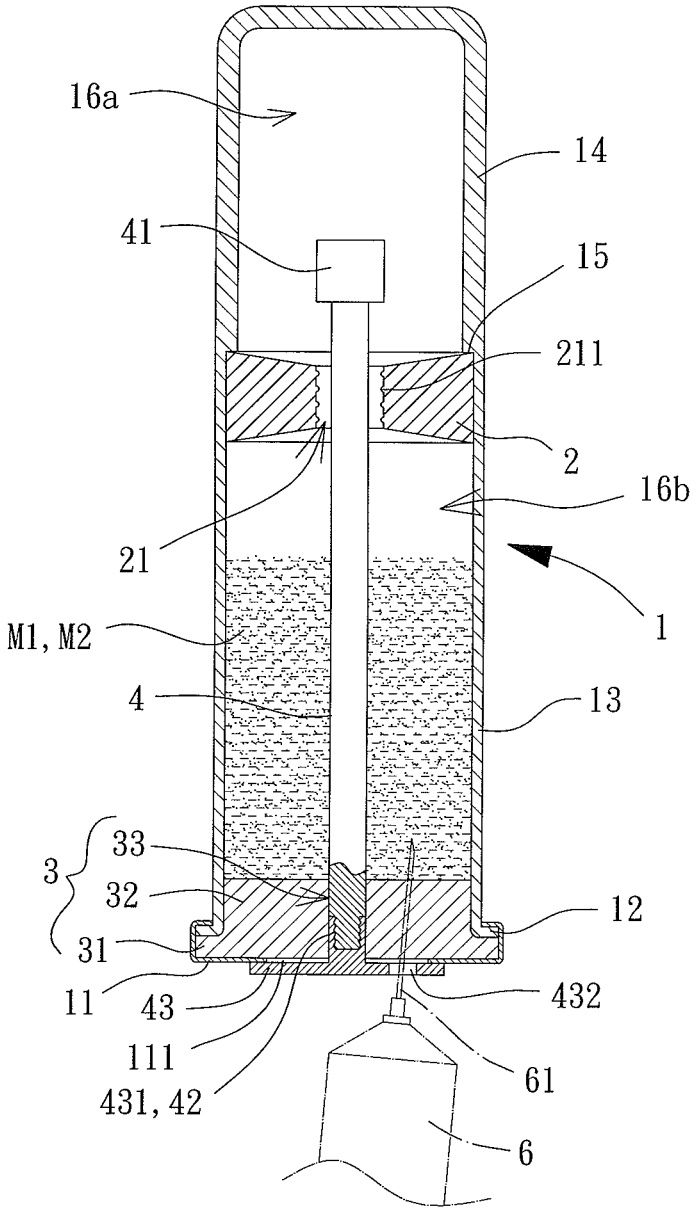
FIG. 7 is another operation view of the medicament container of the first embodiment of the invention.

Referring to FIG. 7, after the first medicament M1 and the second medicament M2 are completely mixed with each other, the medicament container can be turned over to allow the mixed medicament to enter the second chamber 16*b* via the partitioning plug 2. The inclined top and bottom faces of the partitioning plug 2 will facilitate movement of the mixed medicament, thereby reducing the amount of the mixed medicament remained in the first chamber 16*a*. Finally, the needle 61 of the syringe 6 can pass through the needle hole 432 of the holding disc 43 and the through-hole 111 of the cover 11, and pierce the stopper 3 to draw the mixed medicament from the second chamber 16*b*. Thus, the drawn medicament in the syringe 6 can serve a medical purpose for a patient receiving the injection.

Figure 8:
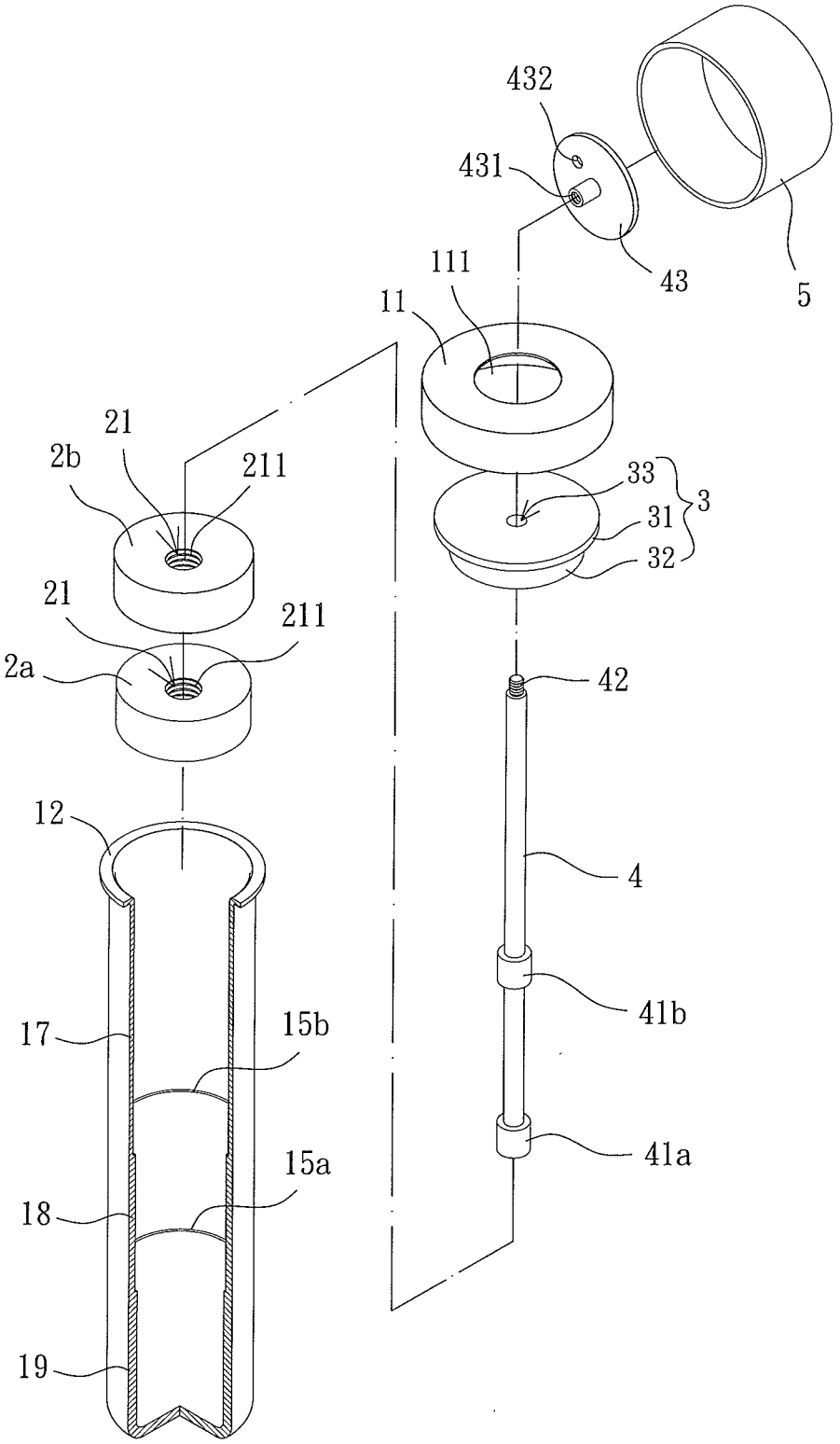
FIG. 8 is an exploded view of a medicament container according to a second embodiment of the invention.

Referring to FIG. 8, an exploded view of a medicament container is disclosed according to a second embodiment of the invention. The medicament container of the second embodiment differs from that of the first embodiment in that the medicament container can accommodate three or more kinds of medicaments. In this embodiment, there are three medicaments received in the medicament container. However, certain components of the medicament container of the second embodiment are similar to the medicament container of the first embodiment, so they will not be described again for brevity.

In this embodiment, the at least one partitioning plug 2 includes two partitioning plugs 2*a* and 2*b*. Similar to the first embodiment, the body 1 has a plurality of sections with different inner diameters to define a plurality of chambers with different sizes. In light of this, the body 1 has a gradually-reduced inner diameter from the opening to the closed end thereof. In other words, the inner diameter of the body 1 will reduce by a scale after each partitioning plug. In this embodiment, the body 1 can be divided into an upper section 17, a middle section 18 and a lower section 19. The upper section 17 is adjacent to the opening of the body 1, the lower section 19 is adjacent to the closed end of the body 1, and the middle section 18 is between the upper section 17 and the lower section 19. The upper section 13 has an even diameter. The middle section 18 has an even but smaller diameter than the upper section 13. The lower section 19 also has an even but smaller diameter than the middle section 18. As such, a blocking face 15*b* is formed where the upper section 17 connects with the middle section 18, and another blocking face 15*a* is also formed where the middle section 18 connects with the lower section 19.

Figure 9:
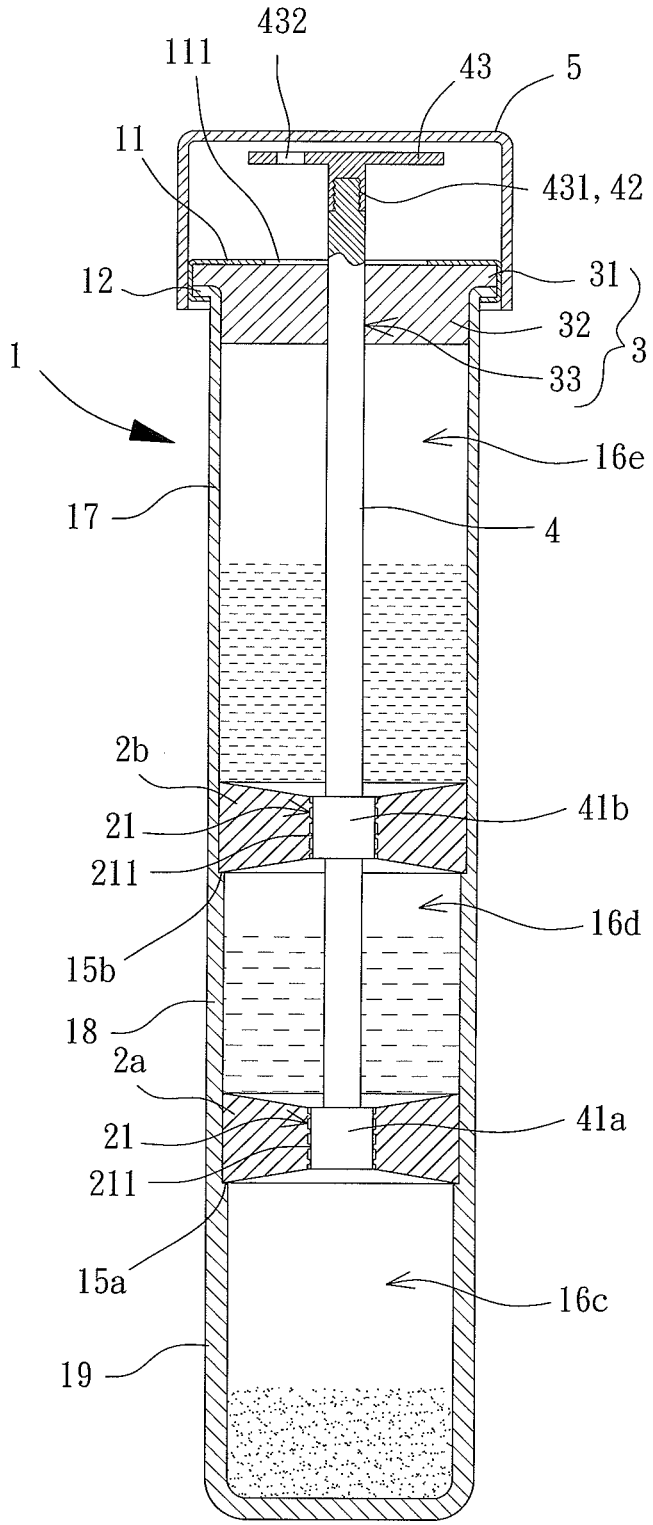
FIG. 9 is a cross-sectional view of the medicament container of the second embodiment of the invention.

Referring to FIGS. 8 and 9, the partitioning plug 2*a* may have an outer diameter equal to the inner diameter of the middle section 18 but larger than the inner diameter of the lower section 19. Similarly, the partitioning plug 2*b* may have an outer diameter equal to the inner diameter of the upper section 17 but larger than the inner diameter of the middle section 18. Thus, the partitioning plug 2*a* can be tightly disposed in the middle section 18 of the body 1 while resting on the blocking face 15*a* between the middle section 18 and the lower section 19, and partitioning plug 2*b* can be tightly disposed in the upper section 17 of the body 1 while resting on the blocking face 15*b* between the upper section 17 and the middle section 18. As such, a third chamber 16*c* is formed between the partitioning plug 2*a* and the closed end of the body 1, a fourth chamber 16*d* is formed between the partitioning plugs 2*a* and 2*b*, and a fifth chamber 16*e* is formed between the partitioning plug 2*b* and the opening of the body 1.

Both partitioning plugs 2*a* and 2*b* have a through-hole 21. A plurality of protruding rings 211 is preferably formed on a circumferential wall of the through-hole 21. Both the partitioning plugs 2*a* and 2*b* have a gradually-reduced thickness from an outer periphery to the through-hole 21 thereof. As such, top and bottom faces of each partitioning plug are of an inclined form. Based on the inclined top and bottom faces, the powdered or liquid medicament can smoothly flow from one to another chamber via the through-hole 21, thereby providing a smooth movement for medicaments received in the medicament container. The stopper 3 may be disposed at the opening of the body 1 to seal the fifth chamber 16*e*.

In this embodiment, the driving rod 4 includes two blocking portions 41*a* and 41*b* corresponding to the partitioning plugs 2*a* and 2*b*. The distance between the blocking portions 41*a* and 41*b* is substantially equal to that between the blocking faces 15*a* and 15*b*. This allows the blocking portions 41*a* and 41*b* to be respectively engaged in the through-holes 21 of the partitioning plugs 2*a* and 2*b* to prevent undesired communication among the chambers 16*c*, 16*d* and 16*e*.

Figure 10:
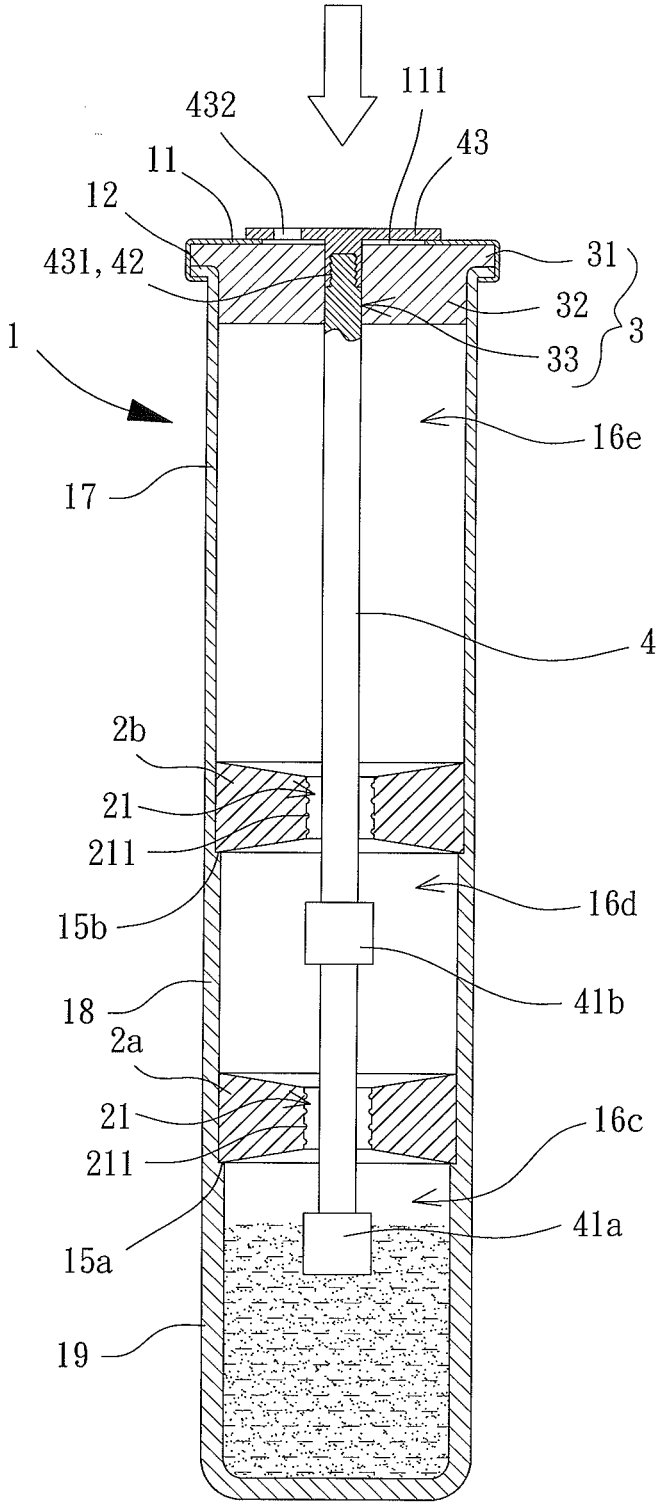
FIG. 10 is an operation view of the medicament container of the second embodiment of the invention.

Referring to FIG. 10, when in use, the outer cover 5 can be removed from the body 1. Then, the holding disc 43 is pressed to disengage the blocking portions 41*a* and 41*b* of the driving rod 4 from the through-holes 21 of the partitioning plugs 2*a* and 2*b* respectively, allowing the chambers 16*c*, 16*d* and 16*e* to communicate with each other. Thus, the medicament in the fifth chamber 16*e* is allowed to enter the third chamber 16*c* via the through-holes 21 of the partitioning plugs 2*a* and 2*b* to mix with the medicament stored in the third chamber 16*c*. Similarly, the medicament in the fourth chamber 16*d* is allowed to enter the third chamber 16*c* via the through-hole 21 of the partitioning plug 2*a* to mix with the medicament stored in the third chamber 16*c*. Based on this, all medicaments of the medicament container can be mixed in the third chamber 16*c*. The medicament container can then be turned upside-down to allow the mixed medicament to enter the fifth chamber 16*e*, and the syringe 6 can draw the mixed medicament from the fifth chamber 16*e* for injection purpose.

In this embodiment, if the medicaments stored in the third chamber 16*c* and the fourth chamber 16*d* are liquid, the medicament container can be directly turned upside-down to allow the liquid medicaments in the chambers 16*c* and 16*d* to enter the fifth chamber 16*e*. Thus, it can be readily appreciated that there are many ways to operate the medicament container of the invention, depending on the material form of the medicaments received in individual chambers.

In summary, the medicament container of the invention has a simple structure and does not require any tool to drive the partitioning plug(s). Instead, the medicament container of the invention simply uses a driving rod, which is coupled with the partitioning plug(s), to disengage the blocking portion(s) of the driving rod from the partitioning plug(s), thereby providing communication between/among the chambers. Thus, mixture of the medicaments received in individual chambers is attained, and better operability is provided.

Furthermore, since the blocking portion(s) of the driving rod that has a relatively large cross section may be disengaged from the partitioning plug(s) that has a relatively small cross section by simply pressing the driving rod, it will be more easy to use the medicament container as the user no longer needs to shake the medicament container to mix the medicaments. Thus, convenient use of the medicament container is provided.

Furthermore, when it is not desired to mix the medicaments stored in the medicament container of the invention, the through-holes of the partitioning plugs 2 are always blocked by larger-diameter portions of the driving rod (namely, the blocking portions of the driving rod). Based on this, when it is desired to mix the medicaments, the larger-diameter portions of the driving rod will be removed to allow communication between the chambers as the driving rod is pressed.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A container comprising:

a body having an opening on one end thereof, as well as a closed end on another end thereof;

at least one partitioning plug disposed in the body to divide the body into at least two chambers, wherein each of the at least one partitioning plug has a through-hole;

a stopper disposed at the opening of the body and having a through-hole;

a driving rod equipped with at least one blocking portion movably engaged in the through-hole of the at least one partitioning plug, wherein one end of the driving rod protrudes from the opening of the body; and a cover abutting against a top face of the stopper, wherein the cover has a through-hole and is coupled with the one end of the body where the opening is, wherein the one end of the driving rod protruding from the opening of the body is formed as an engaging portion, and wherein the driving rod further comprises a holding disc having an engaging portion coupled with the engaging portion of the driving rod.

2. The container as claimed in claim 1, wherein the driving rod has a diameter equal to that of the through-hole of the stopper.

3. The container as claimed in claim 2, wherein the at least one blocking portion has a diameter larger than that of the driving rod.

4. The container as claimed in claim 1, wherein the holding disc has a needle hole overlapped with the through-hole of the cover in an axial direction.

5. The container as claimed in claim 1, further comprising an outer cover covering the holding disc and the one end of the driving rod protruding from the opening of the body.

6. The container as claimed in claim 1, wherein the body has an inner diameter that is reduced, from the opening to the closed end, by a scale after each of the at least one partitioning plug.

7. The container as claimed in claim 1, wherein each of the at least one partitioning plug has a gradually-reduced thickness from an outer periphery to the through-hole thereof.

8. The container as claimed in claim 1, further comprising a plurality of protruding rings formed on a circumferential wall of the through-hole of each of the at least one partitioning plug.

9. The container as claimed in claim 6, wherein the at least one blocking portion comprises a plurality of blocking portions, wherein the body comprises a plurality of sections with different inner diameters, wherein a blocking face is formed between adjacent two of the plurality of sections, and wherein a distance between adjacent two of the plurality of blocking portions is equal to that between two corresponding adjacent blocking faces.

* * * * *